US005311833A

United States Patent [19]

VanTassel et al.

[11] Patent Number: 5,311,833

[45] Date of Patent: * May 17, 1994

[54] WEIGHT RELEASE SYSTEM

[75] Inventors: Charles E. VanTassel, Oceanside; Scott P. Seligman, Carlsbad, both of Calif.

[73] Assignee: Sea Quest, Inc., Carlsbad, Calif.

[ * ] Notice: The portion of the term of this patent subsequent to Feb. 4, 2009 has been disclaimed.

[21] Appl. No.: 738,863

[22] Filed: Aug. 1, 1991

Related U.S. Application Data

[63] Continuation of Ser. No. 402,540, Sep. 1, 1989, Pat. No. 5,085,163.

[51] Int. Cl.[5] ..... B63C 11/46

[52] U.S. Cl. ..... 114/315; 405/186

[58] Field of Search ..... 441/80, 88, 106, 108, 441/111-119; 405/185, 186; 2/2.1 R; 114/315, 331, 317; 272/114

[56] References Cited

FOREIGN PATENT DOCUMENTS 2590540 5/1987 France .

*Primary Examiner*—Robert J. Oberleitner
*Assistant Examiner*—Clifford T. Bartz
*Attorney, Agent, or Firm*—Knobbe, Martens, Olson & Bear

[57] ABSTRACT

A weight release system for selectively releasing a weight from a body. The system includes a retaining member pivotally attached to the body. The retaining member is also releasably engaged to the body distal the pivotal attachment so as to retain and secure a weight relative to the body, so that the center of mass of the weight is substantially between the pivot and the releasable engagement of the retaining member. Upon releasing the retaining member from the body, the weight causes the retaining member to pivot relative to the body so that the weight is below the pivot, thereby permitting separation of the weight from the body.

2 Claims, 2 Drawing Sheets

WEIGHT RELEASE SYSTEM

This application is a continuation of application Ser. No. 402,540, filed Sep. 1, 1989, now U.S. Pat. No. 5,085,163 issued Feb. 4, 1992.

BACKGROUND OF THE INVENTION

This invention relates to weight systems for underwater diving apparatus, and more particularly, to a weight release system for a buoyancy control device, including a pocket for retaining weight modules and a release mechanism for the immediate jettisoning of the weights from the pocket.

DESCRIPTION OF THE PRIOR ART

During underwater activities, it is desirable that the combined weight of the diver and equipment be neutrally buoyant. Neutral buoyancy allows the diver to move efficiently through the underwater environment. If a diver is too buoyant, energy is wasted in attempting to reach the desired depth; while too much weight wastes energy in attempting to stay off the bottom. In addition, the high rates of descent, associated with excess weight, creates a risk of physical damage to the diver.

As the weight of the diver and equipment, including a wet or dry suit, fins, masks, snorkels and air tank, varies from diver to diver, the additional weight necessary to obtain neutral buoyancy in unique to each diver. Therefore, in order to achieve neutral buoyancy of the diver and equipment, a unique quantity of weight must be added to each individual diver.

When attempting to achieve neutral buoyancy, the ability to readily adjust the amount of added weight in an important factor. As the equipment may weigh in excess of 40 pounds, repeated entry of the water in attempting to obtain neutral buoyancy is extremely fatiguing. The convenience of the weight adjustment often dictates the proximity to neutral buoyancy achieved by the diver.

In addition, the distribution of the adder weight is important. If the weight is placed proximate to the air tank on the posterior of the diver, the weight distribution is posterior heavy, thereby rendering the diver unstable. Stability of the diver is an important feature in the safety and capability of the diver and equipment. Therefore, the positioning of the added weight should be such that stability of the diver and equipment is increased (that is the metacentric distance is optimized). In the typical equipment configuration, anterior positioning of the weight increases stability of the diver. Therefore, it is desirable that the added weights are employed on the metric portion of the body.

Even if the weights are disposed about the waist of the diver on a belt, this weight distribution typically renders the diver unstable. Also, if the weight belt is separate from the buoyancy control device, although overall neutral buoyancy of the diver and equipment may be achieved, the diver is subjected to a downward force from the weight belt and an upward force from the buoyancy control device. Therefore, it is preferable that the weights be anteriorally located, and structurally linked to the buoyancy control device so that the entire apparatus exhibits a stable neutral buoyancy.

Although the added weight employed in achieving neutral buoyancy provides the diver with greater underwater capability, the additional wight can complicate an ascent to the surface. In emergency situations in which the diver is usable to return to the surface without assistance, or must return immediately, the added weight can inhibit the return to the surface. Therefore, it is necessary that the added weight can be immediately jettisoned by the diver or a rescuer.

In an attempt to provide a diving apparatus with releasable buoyancy control weights, the prior art has employed reservoirs which retain a fluent mass. The reservoirs are selectively emptied by means of a door or gate. These devices are disclosed in Walters, U.S. Pat. Nos. 3,670,509 and 4,016,616. However, the handling of a fluent mass to provide neutral buoyancy is difficult. In addition, if the fluent mass is wetted during repeated cycles of use, the individual elements in the fluent mass may bridge, or bond, preventing an outflow of the mass when the gate or door is opened, thereby defeating the purpose of the emergency release.

In Anderson, U.S. Pat. No. 3,842,611, a chamber having a manually operable release is employed for retaining a fluent mass. However, Anderson is subject to the same limitations as Walters in that the adjustment of a fluent mass to achieve neutral buoyancy is difficult and cumbersome, in addition to the attendant risk that the fluent mass may bridge within the chamber.

Alternatively, a traditional wight belt may be employed, as disclosed in Courtney, U.S. Pat. No. 4,779,554. In Courtney, a rigid backpack provides a flanged channel about which the weight belt is secured. Although the selective addition and removal of weights may be easier than in fluent mass systems, the entire belt still may be handled in order to adjust the weight to provide the desired buoyancy of the apparatus. In addition, if the buckle of the weight belt is obstructed or damaged in an emergency situation, the release of the weight may be prevented.

A further approach of the prior art is disclosed in Bulin, U.S. Pat. No. 4,608,940. Bulin discloses a sheet of flexible material secured to a buoyancy control device. The sheet and the buoyancy control device are joined so as to form the two parallel sides of a pocket. The bottom of the sheet is folded to form the bottom of a pocket. The folds are secured to the buoyancy control device by a release cord which is received in apertures in the folded sheet. Weights are then added through the top of the pocket. In an emergency situation, the cord is disengaged from the sheet and buoyancy control device to allow the sheet to unfold and the pocket is open. However, the disclosed apparatus of Bulin only provides for release of the weight in certain orientations of the diver, that is, if the diver is horizontal or inverted, the weights will remain in the pocket until the orientation of the diver is such that the weights may pass between the unfolded portion of the sheet and the buoyancy control device. In addition, rearming the pocket after an emergency release is a tedious and time-consuming task.

Therefore, a need exists for a weight release system which readily secures the weights to the anterior portion of the buoyancy control device so that a stable neural buoyancy of the entire device may be quickly achieved. Further, a need exists for the weight release system to be easily armed, without requiring a complicated procedure. In addition, the need exists for the emergency release system to be easily operable and free of encumbrances of other diving equipment so as to provide for the immediate jettisoning of the weights in any orientation of the mechanism.

SUMMARY OF THE INVENTION

A weight release system for underwater diving apparatus is disclosed. Preferably, the weight release system is used in cooperation with a buoyancy control device for retaining modular weights to provide neutral buoyancy during underwater activities.

Preferably, the weight release system includes a retaining member pivotably attached to the buoyancy control device. The retaining member is also releasably engaged to the buoyancy control device. The retaining member may be releasably engaged to the buoyancy control device to support and secure a weight. As the weight is secured by the retaining member, the weight is positioned so that the center of mass of the weight is disposed substantially between the pivotal attachment of the retaining member and the releasable engagement of the retaining member.

A remote release mechanism is mechanically connected to the releasable engagement of the retaining member. The release mechanism provides for the selective release of the retaining member so that the retaining member may pivot relative to the buoyancy control device. Upon operation of the release mechanism, the retaining member is disengaged from the buoyancy control device and the weight causes the retaining member to pivot relative to the buoyancy control device, permitting the weight to separate from the buoyancy control device.

In a preferred embodiment, the retaining member comprises an independent pocket which is pivotally attached to the buoyancy control device. In the preferred embodiment, two pockets are located on the anterior portion of the buoyancy control device to provide an equal weight distribution about the wearer. Each pocket includes an emergency aperture and a loading aperture. Preferably, the loading aperture includes a zipper for providing ready access to the interior of the pocket so that individual weight modules may be added or removed from the pocket to provide a neutral buoyancy of the device. Preferably, the emergency aperture is selectively closed by the releasable engagement of the pocket and the buoyancy control device. Therefore, the emergency aperture and the releasable engagement of the pocket are substantially coterminous. The location of the releasable engagement of the pocket relative to pivotal attachment is such that a weight retained within the pocket will be disposed substantially between the pivotal attachment and the releasable engagement as the releasable engagement closes the emergency aperture.

In an emergency situation, the release mechanism may be activated through a simple motion. A handle affixed to cables to be pulled and the pocket is released from the buoyancy control device at the releasable engagement so that the pocket may pivot relative to the buoyancy control device. The release of the pocket simultaneously opens the emergency aperture. As the emergency aperture is opened, the weights, being between the pivotal attachment and the emergency aperture, cause the pocket to rotate so that the weight is below the pivot and the emergency aperture is below the weights. The weights then exit from the pocket through the open emergency aperture.

Preferably, each individual pocket contains a semi-rigid panel which is conformed to substantially parallel the curvature of the wearer. The semi-rigid panel streamlines the buoyancy control device so as to reduce drag and prevent entanglement of the device with foreign objects.

In the preferred embodiment, the weight release system is located on the anterior portion of the buoyancy control device. The anterior location of the weight release system serves two functions. The first is the ready accessability of the system so that the quantity of weight added may be readily adjusted. The accessibility allows the adjustment to be made either in or out of the water. The second function of the anterior positioning is increasing the stability of the diver. Typically, the equipment configuration is such that anterior weighting improves stability of the diver. Through the addition of anterior weights, the stability of the diver may be increased as neutral buoyancy is achieved.

Further features and advantages of the present invention will become apparent from the detailed description of the preferred embodiment which follows, when taken together with the appended figures and claims.

DETAILED DESCRIPTION OF THE PREFERRED EMBODIMENTS

Figure 1:
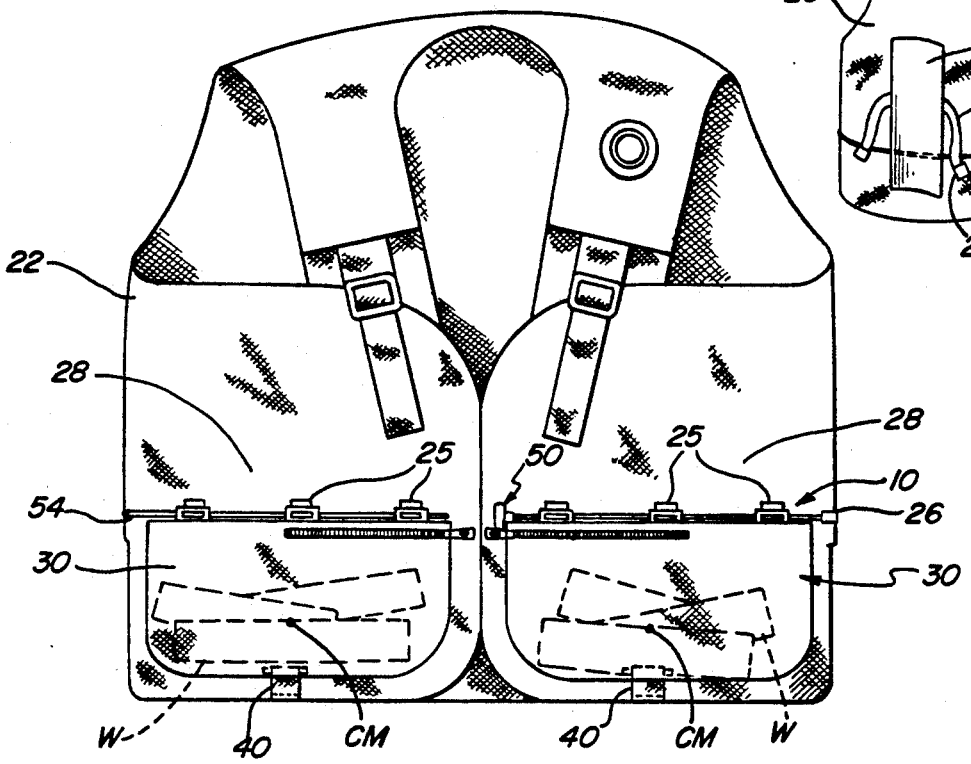
FIG. 1 is a front elevational view of a buoyancy control device showing and armed weight release system.

Referring to FIG. 1, a weight release system 10 for providing the selective release of weights from a buoyancy control device 20 is disclosed. The system 10 includes the buoyancy control device 20, a pocket 30, a pivot 40 and a release mechanism 50.

Buoyancy Control Device

Figure 2:
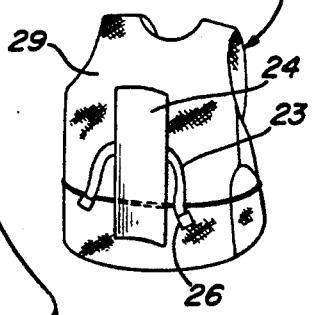
FIG. 2 is a rear perspective of the buoyancy control device showing an air tank mount.

As shown in FIG. 1, the buoyancy control device 20 may comprise a vest 21 sized to secure about the torso of a wearer. As shown in FIGS. 1 and 2, the buoyancy control device 20 is defined to have an anterior portion 28 and a posterior portion 29 separated by a lateral plane, wherein the anterior portion 28 generally covers the chest and midsection of the diver. Referring to FIG. 2, the buoyancy control device 20 includes an air tank mount 22 and strap 23, or clamps (not shown) for retaining the air tank 27 (shown in FIG. 6) to the buoyancy control device 20. The buoyancy control device 20 may also include an inflation device 28 which allows for selective inflation of a bladder (not shown) to adjust the underwater weight of the diver.

Figure 3:
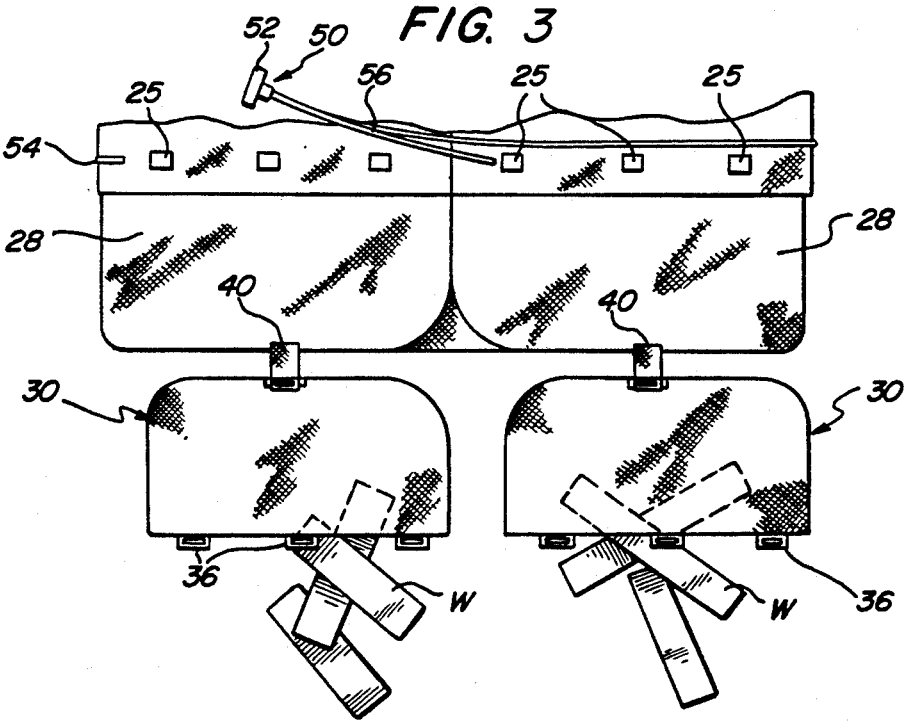
FIG. 3 is a partial front elevational view of the buoyancy control device showing the weight release system in an unarmed configuration.
Figure 4:
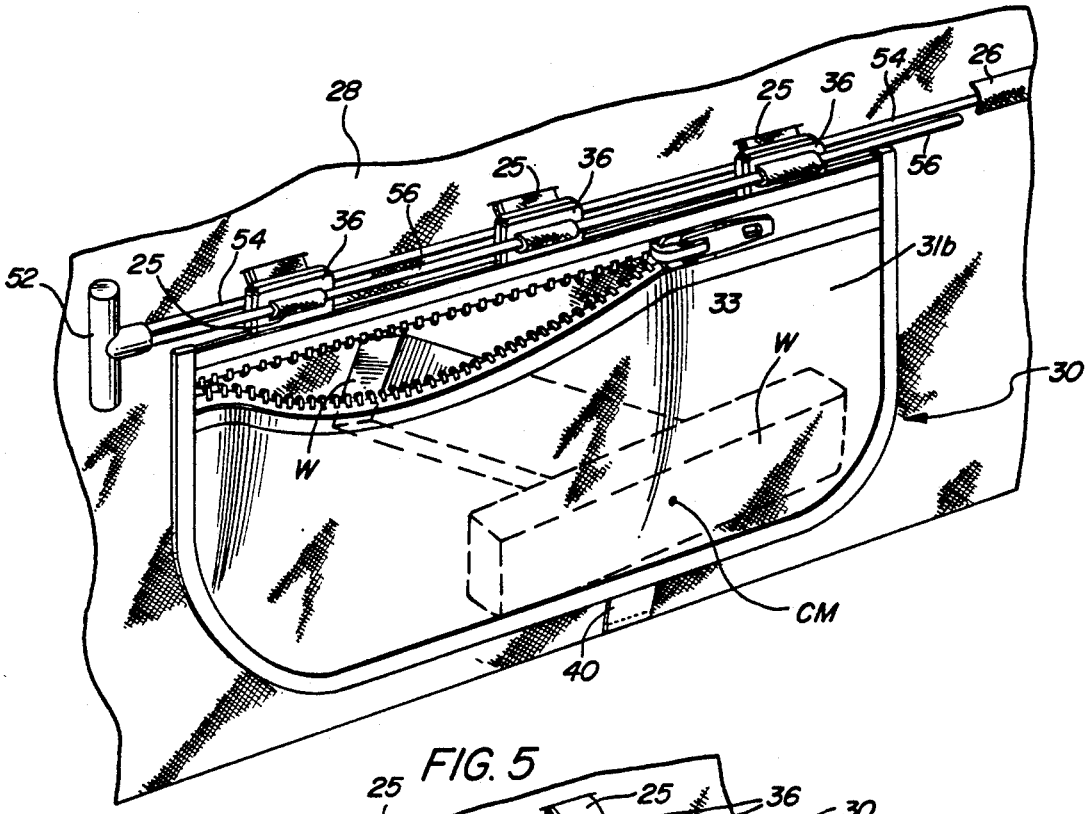
FIG. 4 is a partial perspective view of a weight pocket in the armed configuration of the weight release system.

In connection with the present invention, the anterior portion 28 of the buoyancy control device 20 includes a plurality of securing loops 25, as shown in FIGS. 1, 3 and 4. The securing loops 25 are colinearly aligned as they extend from the anterior portion 28 of the buoyancy control device 20. Referring to FIGS. 1 and 2, the buoyancy control device 20 also includes a passageway 26 extending substantially colinearly from the loops 25 through the buoyancy control device 20 and terminating proximal to a second set of securing loops 25 on the right-hand side of the wearer. The passageway 26 is sized to slidably receive a cable 54.

Weight Pockets

Figure 5:
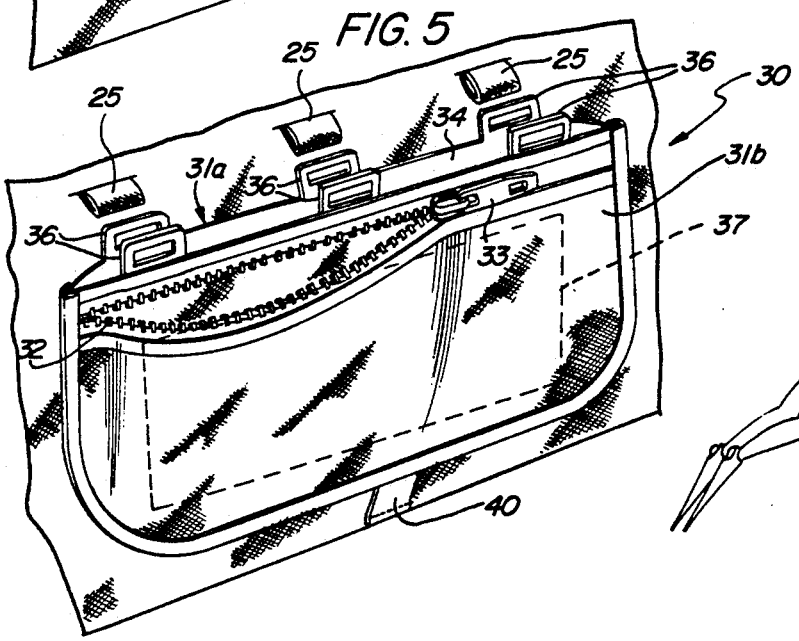
FIG. 5 is a perspective view of a weight pocket in an unarmed configuration of the weight release system.

As shown in FIGS. 1 and 3, the individual weight pockets 30 are pivotally attached to the anterior portion 28 of the buoyancy control device 20. The pockets 30 represent an embodiment of a retaining member for securing weights relative to a body, i.e., the buoyancy control device 20. Referring to FIGS. 4 and 5, each pocket 30 is comprised of two panels 31*a* and 31*b*, which are securely affixed to each other substantially about their periphery. Each pocket 30 includes a loading aperture 32 and an emergency aperture 34. Preferably, the loading aperture 32 is formed in the outer panel 31*b* and may be selectively closed by a slide fastener such as a zipper 33 so as to provide easy opening and closure of the loading aperture 32. Alternative means for selectively closing the loading aperture 32, such as mating hook and loop fasteners, may be employed. As shown in FIG. 5, the emergency aperture 34 is formed by the nonsecured portion of the periphery of the panels 31*a* and 31*b*. Preferably, the pocket 30 is sized so that a weight W may be retained within the pocket so as to be disposed substantially interjacent the pivot 40 and the releasable engagement of the pocket as it closes the emergency aperture 34, that is, a center mass CM of the weight W is between the emergency aperture 34 at the point of releasable engagement of the pocket 30 and the pivot 40.

In addition, each panel 31*a*, 31*b* includes arming apertures 36 sized and spaced to receive the securing loops 25. As discussed infra, the arming apertures 36, the securing loops 25 and cables 54, 56 provide a releasable attachment of the pocket 30 to the buoyancy control device 20 in addition to selectively closing the emergency aperture 34. Referring to FIG. 5, the panel 31*a* includes a semi-rigid member 37 (shown in phantom) contoured to substantially conform to the body of the wearer (not shown). The contour of the pocket 30 also reduces the risk of the pockets 30 becoming entangled with each other gear and reduces the drag of the buoyancy control device.

Pivot

As shown in FIGS. 1, 3, 4 and 5, the pivot 40 mechanically connects the pocket 30 to the anterior portion 28 of the buoyancy control device 20. The pivot 40 provides a pivotal attachment of the retaining member, or pocket 30 to the buoyancy control device 20. Preferably, the pivot 40 provides for universal rotation or pivotability of the pocket 30 relative to the buoyancy control device 20. As shown in FIGS. 1, 3, 4 and 5, the pivot 40 may comprise a strap 40 which connects to the bottom of the pocket 30 and the buoyancy control device 20 distal the securing loops 25. Preferably, the distal attachment of the pivot 40 to the bottom of the pocket 30 provides that a retained weight W is disposed between the pivot 40 and the emergency aperture 34 as it is selectively closed by the releasable engagement of the pocket 30 to the buoyancy control device 20.

Release Mechanism

The release mechanism 50 includes a handle 52 affixed to the two lengths of cable 54, 56. The release mechanism 50 cooperates with the releasable attachment of the pocket 30 to provide for the selective release of the releasable attachment. As discussed infra, the releasable attachment may include the securing loops 25 and the arming apertures 36. The cable 54 is longer than cable 56 and has a length sufficient to extend substantially about the buoyancy control device 20 so as to engage a second set of securing loops 25. The longer cable 54 is sized to be slidably received in the passageway 26. The cables 54, 56 are sized to be slidably received in the securing loops 25 as the loops 25 are passed through the arming apertures 36.

In the armed configuration, as discussed infra, the handle 52 is disposed proximal to the pocket 30 on the left side of the wearer. the cable 54 extends past the securing loops on the left of the buoyancy control device 20, through the passageway 26, to the securing loops 25 on the right-hand side of the wearer. The cable 56 has a length sufficient to permit the cable 56 to extend through the securing loops 25 on the left side of the wearer.

Although the weight release system 10 has been described with the pivot 40 located below the emergency aperture 34, in an alternative embodiment the pivot 40 may be disposed above the emergency aperture 34, that is, the emergency aperture 34 may be proximal to the bottom of the pocket 30 and the pivot 40 distally disposed proximal to the top of the pocket 30. In this alternative embodiment, the releasable attachment of the pocket 30 and closure of the emergency aperture 34 would be proximate to the bottom of the pocket 30. However, in this alternative embodiment, the loading aperture 32 may still be located proximal to the top of the pocket 30. As discussed infra, the critical consideration is the retention of the center of mass CM of the weight W substantially between the pivot 40 and the distal releasable attachment and closure of the emergency aperture 34.

Figure 6:
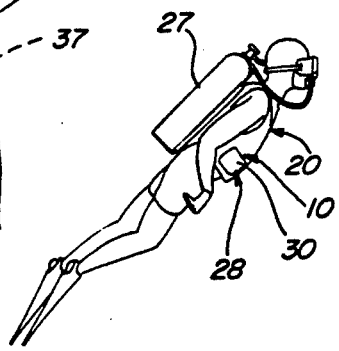
FIG. 6 is a side view of a submersed diver showing the relative position of the weight release system.

Referring to FIG. 6, the weight release system 10 is preferably disposed on the anterior portion 28 of the buoyancy control device 20. The anterior position of the weight release system 10 provides ready access to the pocket 30, so that the amount of weight W may be easily adjusted. In addition, the anterior positioning provides for an increased stability of the driver. Although weights W may be located posteriorly, the typical configuration of the buoyancy control device requires anterior weights to improve stability.

As submersed or floating bodies having the center of gravity below the center of buoyancy are rotationally stable, it is desirable that center of gravity of the diver, CG, be below the center of buoyancy of the diver CB. By positioning the weights W on the anterior portion 28, the center of gravity CG shall be lowered relative to the center of buoyancy CB and thereby increase the rotational stability of the diver.

Operation of the Weight Release System

A. Arming the Weight Release System

As shown in FIGS. 1 and 4, the weight release system 10 is operably employed in an armed configuration. The securing loops 25 are passed through the arming apertures 36 of each panel 31*a* and 31*b*, thereby closing the emergency aperture 34. Referring to FIGS. 1 and 4, the cable 54 is passed through the loops 25 as they extend through the arming apertures 36, thereby preventing passage of the loops 25 through the arming apertures 36. As shown in FIG. 1, the cable 54 extends through the passageway 26 to engage the securing loops 25 in the right-hand side of the buoyancy control device 20. As shown in FIG. 4, the length of the securing loops 25 is such that upon receiving the cable 54 through the loop 25, the arming apertures 36 of the panels 31*a* and 31*b* are proximal to each other, thereby closing the emergency aperture 34 to the weight W. In addition, rotation of the pocket 30 about the pivot 40 is prevented by engagement of the arming apertures 30 and the securing loops 25. As shown in FIGS. 1 and 4, the center of mass CM of the weight W is between the pivot 40 and the distal releasable engagement and closure of the emergency aperture 34 in the armed configuration.

B. Activating the Weight Release System

During emergency situations, the weight release system 10 may be activated to separate the weight W from the buoyancy control device 20. To activate the weight release system 10, the handle 52 is pulled away from the body in a manner substantially similar to the release motion in a traditional buckle weight belt. As the handle 52 is pulled, the cables 54 and 56 pass through the securing loops 25, thereby permitting the securing loops 25 to pass through the arming apertures 36. As the securing loops 25 pass through the arming apertures 36, the emergency aperture 34 opens. By releasing the arming apertures 36 from the securing loops 25, the weight W, as acted on by gravity, may rotate the pocket 30 about the pivot 40. Because the center of mass CM of the weight W was between the releasable attachment as it closed the emergency aperture 34 and the pivot 40 in the armed configuration, upon release of the pocket 30 to rotate about the pivot 40, the weight W will cause the pocket 30 to reorient so that the center of mass CM of the weight W is below the pivot 40. As the emergency aperture 34 is below the center of mass CM of the weight W, the weight W will then pass through the emergency aperture. Preferably, the pivot 40 permits the pocket 30 to assume substantially any orientation relative to the buoyancy device 20 so that the weight release system 10 is operable in any orientation, that is, the diver may be in positions including prone, inverted or sideways and the weight release system 10 will permit separation of the weight W from the buoyancy control device 20.

Upon return to the surface, the pockets may be readily rearmed by rethreading the cable as discussed in the arming operation.

Although the invention has been described in terms of certain preferred embodiments, other embodiments that are apparent to those of skill in the art are also within the scope of this invention. Accordingly, the scope of the invention is intended to be defined only by reference to the appended claims.

We claim:

1. A weight release system for selectively releasing a weight from a diver comprising:

a buoyancy control device wearable about the torso of the diver;

a retaining member secured at one end to the buoyancy control device and releasable at the other end from the buoyancy control device, said second end being releasable while said first end remains secured, said retaining member retaining a weight, said retaining member being positioned so that when the weight is held by the retaining member and when the diver is in a substantially prone position, the center of mass of the diver relative to the center of buoyancy of the diver is lowered thereby increasing the rotational stability of the diver, the weight being releasable by a releasing means simultaneously from said retaining member and away from the diver in a manner such that said retaining member remains affixed to the buoyancy control device, thereby permitting the diver to reload said retaining member with an additional weight without reattaching said retaining member to said buoyancy control device, and a release mechanism slidably engaged proximate to the center of an interior portion of said buoyancy control device.

2. A weight release system for selectively releasing a weight from a diver comprising; a vest wearable about the torso of the diver, a retaining member separate from the vest releasably secured about the torso of the diver for retaining a weight, said retaining member being configured so as to permit the release of the weight away from an anterior portion of the diver under normal forces of gravity acting on said weight when the diver is either in an upright, prone or partially inverted orientation, and a release mechanism slidably engaged to the retaining member proximate to the center of an anterior portion of the diver, said release mechanism being engaged in such a way as to require only a slidable action to release the weight.

* * * * *